US010563866B2

(12) United States Patent
Balandier et al.

(10) Patent No.: US 10,563,866 B2
(45) Date of Patent: Feb. 18, 2020

(54) ANNULAR COMBUSTION CHAMBER WALL ARRANGEMENT

(71) Applicant: ROLLS-ROYCE PLC, London (GB)

(72) Inventors: Quentin Luc Balandier, Derby (GB); Douglas Alexander Chalmers, Abderdeen (GB)

(73) Assignee: ROLLS-ROYCE PLC, London (GB)

( * ) Notice: Subject to any disclaimer, the term of this patent is extended or adjusted under 35 U.S.C. 154(b) by 389 days.

(21) Appl. No.: 14/743,181

(22) Filed: Jun. 18, 2015

(65) Prior Publication Data

US 2016/0010862 A1 Jan. 14, 2016

(30) Foreign Application Priority Data

Jul. 14, 2014 (GB) ..... 1412460.6

(51) Int. Cl.
*F23R 3/02* (2006.01)
*F23R 3/00* (2006.01)
(Continued)

(52) U.S. Cl.
CPC ..... *F23R 3/007* (2013.01); *F23M 5/02* (2013.01); *F23R 3/002* (2013.01); *F23R 3/04* (2013.01);
(Continued)

(58) Field of Classification Search
CPC .. F23R 3/002; F23R 3/007; F23R 3/04; F23R 3/06; F23R 2900/03041–03045;
(Continued)

(56) References Cited

U.S. PATENT DOCUMENTS 5,737,922 A * 4/1998 Schoenman ..... F23R 3/002 165/168
5,799,491 A * 9/1998 Bell ..... F23R 3/002 60/752
(Continued)

FOREIGN PATENT DOCUMENTS

EP 2 241 808 A1 10/2010
FR 2946413 7/1960

OTHER PUBLICATIONS

Nov. 4, 2015 Search Report issued in European Patent Application No. 15172537.
(Continued)

*Primary Examiner* — Todd E Manahan
*Assistant Examiner* — Katheryn A Malatek
(74) *Attorney, Agent, or Firm* — Oliff PLC

(57) ABSTRACT

An annular combustion chamber wall arrangement includes an annular wall and a plurality of tiles and each tile is secured to and is spaced from a further annular wall. The first surface of each tile faces the annular wall and the second surface of each tile faces away from the annular wall. Each tile has a plurality of pedestals extending away from the first surface towards the annular wall and/or a plurality of effusion cooling apertures extending through the tile from the first surface to the second surface. At least one of the tiles has the pedestals and/or the effusion cooling apertures arranged in a predetermined pattern which provides the tile with a more uniform stiffness in all directions to reduce the possibility of cracking of the tile. In one predetermined pattern the pedestals are arranged in a Fermat's (parabolic) spiral with the pedestals arranged with Fibonacci number ordering.

3 Claims, 4 Drawing Sheets

(51) Int. Cl.
*F23M 5/02* (2006.01)
*F23R 3/06* (2006.01)
*F23R 3/04* (2006.01)

(52) U.S. Cl.
CPC ..... *F23R 3/06* (2013.01); *F23M 2700/0053* (2013.01); *F23R 2900/03041* (2013.01); *F23R 2900/03045* (2013.01)

(58) Field of Classification Search
CPC .... F23M 5/02; F23M 2700/0053; F02C 7/12; F02C 7/18; F05D 2260/2212; F05D 2260/2214; F05D 2260/22141
See application file for complete search history.

(56) References Cited

U.S. PATENT DOCUMENTS 6,170,266 B1 1/2001 Pidcock et al.
6,546,731 B2 * 4/2003 Alkabie ..... F23R 3/002 60/754
6,681,578 B1 1/2004 Bunker
2001/0004835 A1 6/2001 Alkabie et al.
2002/0124572 A1 * 9/2002 Pidcock ..... F23R 3/002 60/796
2005/0241316 A1 * 11/2005 Nguyen ..... F23R 3/10 60/772
2006/0060334 A1 * 3/2006 Joe ..... F01D 5/187 165/109.1
2006/0117755 A1 6/2006 Spooner et al.
2009/0013530 A1 * 1/2009 Rudrapatna ..... F23R 3/002 29/888
2010/0242488 A1 * 9/2010 Veninger ..... F23L 7/005 60/772
2010/0251722 A1 10/2010 Woolford et al.
2011/0108257 A1 * 5/2011 Miyake ..... F01D 25/12 165/168
2012/0324894 A1 * 12/2012 Dierberger ..... F23R 3/002 60/722
2013/0327057 A1 * 12/2013 Cunha ..... F23R 3/002 60/782
2013/0340437 A1 * 12/2013 Erbas-Sen ..... F23R 3/06 60/754
2014/0020393 A1 * 1/2014 Nakamata ..... F23R 3/002 60/754

OTHER PUBLICATIONS

Jan. 14, 2015 Search Report issued in British Application No. 1412460.6.

* cited by examiner

ANNULAR COMBUSTION CHAMBER WALL ARRANGEMENT

FIELD OF THE DISCLOSURE

The present disclosure relates to an annular combustion chamber wall arrangement, in particular relates to a gas turbine engine annular combustion chamber wall arrangement and more particularly relates to a gas turbine engine annular combustion chamber wall and tile arrangement.

BACKGROUND TO THE DISCLOSURE

An annular gas turbine engine combustion chamber comprises an annular upstream end wall, an inner annular wall and an outer annular wall. The annular upstream end wall has a plurality of circumferentially spaced apertures and an associated fuel injector is located in each of the apertures in the annular upstream end wall.

Conventionally an annular gas turbine engine combustion chamber is provided with a plurality of heat shields, tiles, arranged downstream of the annular upstream end wall to thermally protect the upstream wall of the combustion chamber. Each heat shield, tile, is provided with a central aperture which is aligned with a corresponding aperture in the annular upstream end wall and the associated fuel injector.

The annular gas turbine engine combustion chamber is provided with a plurality of tiles arranged radially outside of the inner annular wall to thermally protect the inner annular wall of the combustion chamber and a plurality of tiles arranged radially inside the outer annular wall to thermally protect the outer annular wall of the combustion chamber.

Conventionally each heat shield is provided with a plurality of pedestals, or projections, which extend in an upstream direction away from the upstream, cold, surface of the heat shield. Similarly, each tile on the inner annular wall is provided with a plurality of pedestals which extend in a radially inwardly direction from the radially inner, cold, surface of the tile and each tile on the outer annular wall is provided with a plurality of pedestals which extend in a radially outwardly direction from the radially outer, cold, surface of the tile. The pedestals provide cooling of the heat shield and/or tile by conducting heat away from the heat shield and/or tile and the heat is transferred to coolant flowing around and between the pedestals. These pedestals are arranged in regular patterns on the heat shields and tiles, for example the pedestals are arranged in a hexagonal pattern with a pedestal arranged at each of the six corners of the hexagon and a pedestal arranged at the centre of the hexagon and thus the pedestals are arranged in a plurality of parallel straight lines. The pedestals are generally circular in cross-section.

However, it has been found that the tiles suffer from cracking during service in a gas turbine engine combustion chamber and in some circumstances a tile has failed due to a crack extending all the way across the tile. A crack generally forms along a weak line, or weak section, of a tile, e.g. a line or section of the tile which is weaker than the remainder of the tile, and it has now been found that the regular, hexagonal, pattern of pedestals on a tile produces one or more weak lines or weak sections. The crack generally forms substantially in a line between two adjacent rows of pedestals. The weak lines, or weak sections, have lower bending stiffness than the remainder of the tile and are susceptible to failure with various resonant frequencies and with thermal and pressure loading in the combustion chamber.

Alternatively, each tile on the inner annular wall is provided with a plurality of effusion cooling apertures which extend through the tile to provide a film of coolant on the radially outer, hot, surface of the tile and each tile on the outer annular wall is provided with a plurality of effusion cooling apertures which extend through the tile to provide a film of coolant on the radially inner, hot, surface of the tile. These effusion cooling apertures are arranged in regular patterns on the tiles, for example the effusion cooling apertures are arranged in a hexagonal pattern with an effusion cooling aperture arranged at each of the six corners of the hexagon and an effusion cooling aperture arranged at the centre of the hexagon and thus the effusion cooling apertures are arranged in a plurality of parallel straight lines. The effusion cooling apertures are generally circular in cross-section.

However, there is a possibility that these tiles may suffer from cracking during service in a gas turbine engine combustion chamber and in some circumstances it may be possible that a tile may fail due to a crack extending all the way across the tile. A crack generally forms along a weak line, or weak section, of a tile, e.g. a line or section of the tile which is weaker than the remainder of the tile. It is postulated that the regular, hexagonal, pattern of effusion cooling apertures on a tile may produce one or more weak lines or weak sections in a similar manner to the tiles with pedestals. The crack generally forms substantially in a line of effusion cooling apertures. The weak lines, or weak sections, have lower bending stiffness than the remainder of the tile and may be susceptible to failure with various resonant frequencies and with thermal and pressure loading in the combustion chamber.

It is therefore necessary to periodically inspect a combustion chamber using a boroscope to determine whether a tile has cracked, or has not cracked, and if it is determined that a tile has cracked it is replaced.

Therefore the present disclosure seeks to provide a novel annular combustion chamber wall and tile arrangement which reduces or overcomes the above mentioned problem.

STATEMENTS OF DISCLOSURE

Accordingly the present disclosure provides an annular combustion chamber wall arrangement comprises an annular wall, the annular wall has a first surface and a second surface, the wall has a plurality of pedestals extending away from the first surface and/or a plurality of effusion cooling apertures extending through the annular wall from the first surface to the second surface, the annular wall has the pedestals and/or the effusion cooling apertures arranged in a predetermined pattern, wherein the predetermined pattern provides the annular wall with a substantially uniform stiffness in all directions.

The predetermined pattern may provide substantially the same stiffness, or strength, in each cross-section through the annular wall.

The annular wall may comprise a plurality of tiles, each tile is secured to and is spaced from a further annular wall, each tile has a first surface and a second surface, the first surface of each tile faces the further annular wall and the second surface of each tile faces away from the further annular wall, each tile has a plurality of pedestals extending away from the first surface towards the further annular wall and/or a plurality of effusion cooling apertures extending through the tile from the first surface to the second surface, at least one of the tiles has the pedestals and/or the effusion cooling apertures arranged in a predetermined pattern, wherein the predetermined pattern provides the tile with a substantially uniform stiffness in all directions.

The predetermined pattern may provide substantially the same stiffness, or strength, in each cross-section through the tile.

A plurality of the tiles may have the pedestals or the effusion cooling apertures arranged in the predetermined pattern.

The annular wall may have the pedestals or the effusion cooling apertures arranged such that there are no direct lines across the first surface of the annular wall without at least one pedestal or at least one effusion cooling aperture.

At least one of the tiles may have the pedestals or the effusion cooling apertures arranged such that there are no direct lines across the first surface of the tile without at least one pedestal or at least one effusion cooling aperture.

A plurality of the tiles may have the pedestals or the effusion cooling apertures arranged such that there are no direct lines across the first surface of the tile without at least one pedestal or at least one effusion cooling aperture.

All of the tiles may have the pedestals or the effusion cooling apertures arranged such that there are no direct lines across the first surface of the tile without at least one pedestal or at least one effusion cooling aperture.

The pedestals or the effusion cooling apertures may be arranged in a random pattern.

The pedestals or the effusion cooling apertures may be arranged on Fermat's spiral, in which the pedestals or effusion cooling apertures are arranged with Fibonacci number ordering, e.g. $\theta=2\pi/\phi^2\times n$, $r=c\sqrt{n}$, $\theta=n\times 137.508°$, when n is the index number of the pedestal or effusion cooling aperture, c is a constant scaling factor and r is the radius or distance from the centre.

The pedestals or the effusion cooling apertures may be arranged in a pentagonal pattern, the pentagonal pattern comprising a plurality of pentagons, each pentagon comprising five pedestals or effusion cooling apertures, each pedestal or effusion cooling aperture is arranged at a respective corner of the pentagon, and each pedestal or effusion cooling aperture is arranged in a single pentagon.

All of the pedestals or effusion cooling apertures may have the same cross-sectional shape. The pedestals or effusion cooling apertures may be circular in cross-section. All of the pedestals or effusion cooling apertures may be circular in cross-section.

The pedestals may be arranged generally in a regular hexagonal pattern, a pedestal is arranged at each corner of the hexagon and a pedestal is arranged at the centre of each hexagon, the pedestals are arranged in parallel rows, the rows of pedestals defining a plurality of parallel channels, a plurality of interconnecting members are provided, each interconnecting member connecting two adjacent pedestals, at least one interconnecting member is arranged to extend across each of the channels.

A plurality of interconnecting members may extend across each channel.

The effusion cooling apertures may be arranged generally in a regular hexagonal pattern, an effusion cooling aperture is arranged at each corner of the hexagon and an effusion cooing aperture is arranged at the centre of each hexagon, the effusion cooling apertures are arranged in parallel rows, the rows of effusion cooling apertures defining a plurality of parallel channels, a plurality of slots are provided, each slot extending between two adjacent effusion cooling apertures, at least one slot is arranged to extend across each of the channels.

A plurality of slots may extend across each channel.

Each tile may be secured to the annular wall by a fastener arrangement. The fastener arrangement may comprise a plurality of threaded studs extending from the tile and a plurality of cooperating nuts.

The annular wall may have a plurality of apertures extending there-through to supply coolant into a chamber between the annular wall and the tiles.

The annular wall may be a radially inner annular wall of an annular combustion chamber. The radially outer surface of each tile may have a thermal barrier coating.

The annular wall may be a radially outer annular wall of an annular combustion chamber. The radially inner surface of each tile may have a thermal barrier coating.

The annular wall may be an annular wall of a tubular combustion chamber. The radially inner surface of each tile may have a thermal barrier coating.

The annular wall may be an annular upstream end wall of an annular combustion chamber. Each tile may have a plurality of pedestals extending in an upstream direction from the upstream surface of the tile. The downstream surface of each tile may have a thermal barrier coating.

The annular combustion chamber wall and tile arrangement may be a gas turbine engine annular combustion chamber wall and tile arrangement. The gas turbine engine may be an aero gas turbine engine, a marine gas turbine engine, an industrial gas turbine engine or an automotive gas turbine engine. The aero gas turbine engine may be a turbofan gas turbine engine, a turboprop gas turbine engine, a turbojet gas turbine engine or a turbo shaft gas turbine engine.

BRIEF DESCRIPTION OF THE DRAWINGS

The present disclosure will be more fully described by way of example with reference to the accompanying drawings, in which:—

DETAILED DESCRIPTION

Figure 1:
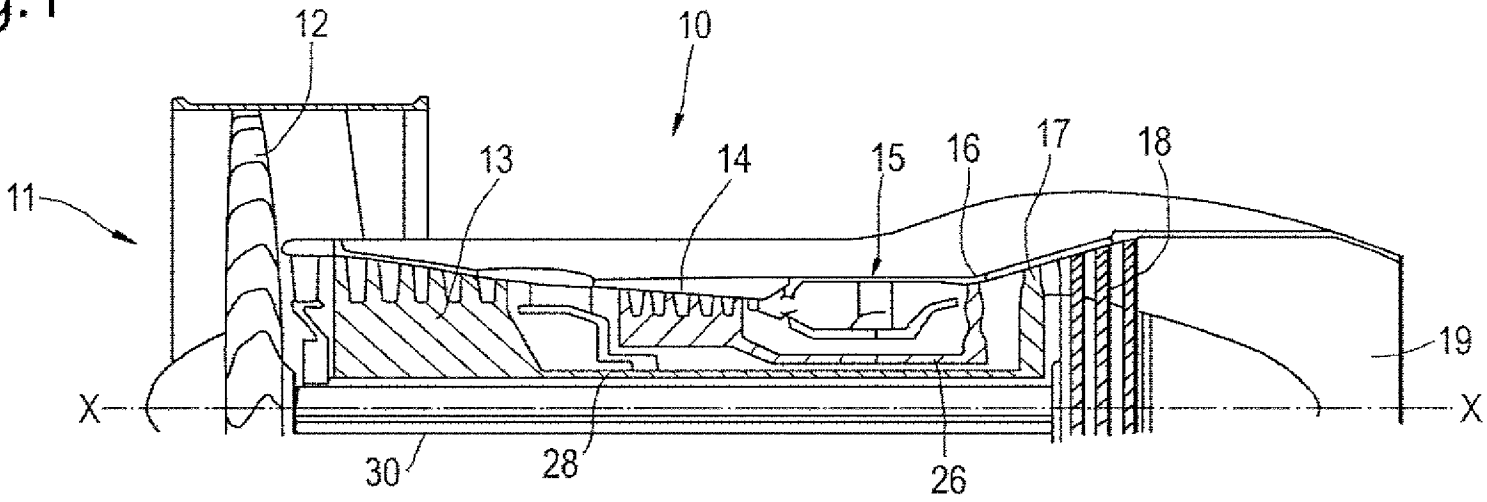
FIG. 1 is partially cut away view of a turbofan gas turbine engine combustion chamber having an annular combustion chamber wall and tile arrangement according to the present disclosure.

A turbofan gas turbine engine 10, as shown in FIG. 1, comprises in flow series an intake 11, a fan 12, an intermediate pressure compressor 13, a high pressure compressor 14, a combustion chamber 15, a high pressure turbine 16, an intermediate pressure turbine 17, a low pressure turbine 18 and an exhaust 19. The high pressure turbine 16 is arranged to drive the high pressure compressor 14 via a first shaft 26. The intermediate pressure turbine 17 is arranged to drive the intermediate pressure compressor 13 via a second shaft 28 and the low pressure turbine 18 is arranged to drive the fan 12 via a third shaft 30. In operation air flows into the intake 11 and is compressed by the fan 12. A first portion of the air flows through, and is compressed by, the intermediate pressure compressor 13 and the high pressure compressor 14 and is supplied to the combustion chamber 15. Fuel is injected into the combustion chamber 15 and is burnt in the air to produce hot exhaust gases which flow through, and drive, the high pressure turbine 16, the intermediate pressure turbine 17 and the low pressure turbine 18. The hot exhaust gases leaving the low pressure turbine 18 flow through the exhaust 19 to provide propulsive thrust. A second portion of the air bypasses the main engine to provide propulsive thrust.

Figure 2:
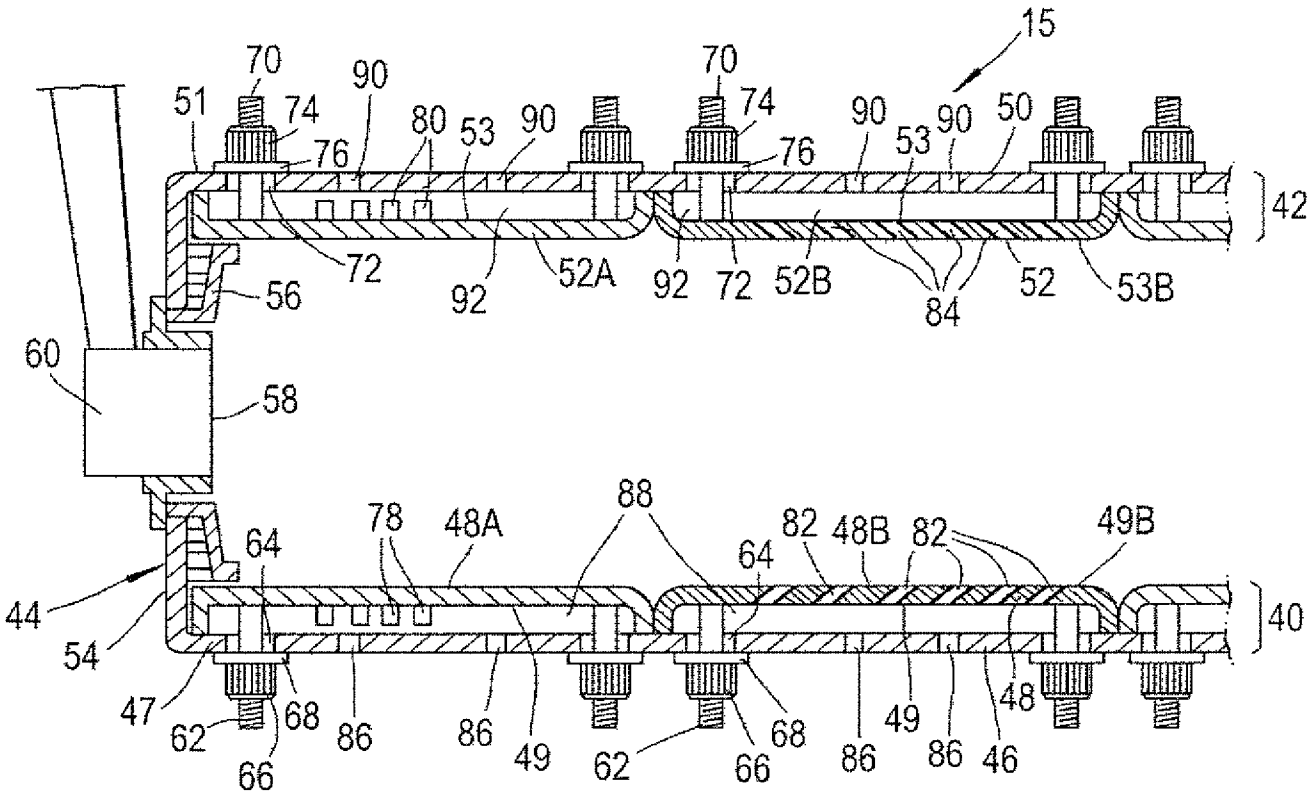
FIG. 2 is an enlarged cross-sectional view of a combustion chamber having an annular combustion chamber wall and tile arrangement according to the present disclosure.

The combustion chamber 15, as shown more clearly in FIG. 2, is an annular combustion chamber and comprises a radially inner annular wall structure 40, a radially outer annular wall structure 42 and an upstream end wall structure 44. The radially inner annular wall structure 40 comprises a first annular wall 46 and a second annular wall 48. The radially outer annular wall structure 42 comprises a third annular wall 50 and a fourth annular wall 52, The second annular wall 48 is spaced radially from and is arranged radially around the first annular wall 46 and the first annular wall 46 supports the second annular wall 48. The fourth annular wall 52 is spaced radially from and is arranged radially within the third annular wall 50 and the third annular wall 50 supports the fourth annular wall 52. In this arrangement the second annular wall 48 comprises a plurality of rows of tiles 48A, 48B and the fourth annular wall 52 comprises a plurality of rows of tiles 52A, 52B. The rows of tile 48A, 48B are arranged adjacent to each other axially along the combustion chamber 15 and there are a plurality of tiles arranged end to end circumferentially around the annular combustion chamber 15 in each of the rows of tiles 48A and 48B. Similarly the rows of tile 52A, 52B are arranged adjacent to each other axially along the combustion chamber 15 and there are a plurality of tiles arranged end to end circumferentially around the annular combustion chamber 15 in each of the rows of tiles 52A and 52B. The upstream end wall structure 44 comprises an annular upstream end wall 54 and a plurality of heat shields 56. The heat shields 56 are arranged end to end circumferentially around the annular combustion chamber 15. The annular upstream end wall 54 is also known as a metering panel. The heat shields 56 are spaced axially downstream from the upstream end wall 54 and the annular upstream end wall 54 supports the heat shields 56. The upstream end of the first annular wall 46 is secured to the annular upstream end wall 54 and the upstream end of the third annular wall 50 is secured to the annular upstream end wall 54. The annular upstream end wall 54 has a plurality of circumferentially spaced apertures 58 and each aperture 58 has a respective one of a plurality of fuel injectors 60 located therein. The apertures 58 are equi-angularly spaced around the annular upstream end wall 54 and the apertures 58 are generally circular. The fuel injectors 60 are arranged to supply fuel into the annular combustion chamber 15 during operation of the gas turbine engine 10. The fuel injectors may be rich burn fuel injectors and generally comprises two or three air swirlers to atomise a main fuel supply. Alternatively the fuel injectors 60 may be lean burn fuel injectors and generally comprise four or five air swirlers to atomise a pilot fuel supply and a main fuel supply. The annular combustion chamber 15 has an axis which is coaxial with the axis X of the turbofan gas turbine engine 10.

The tiles 48A, 48B of the second annular wall 48 are supported on the first annular wall 46 by suitable fasteners. In this example threaded studs 62 extend from the radially inner surface 49 of the tiles 48A, 48B through apertures 64 in the first annular wall 46 and washers 68 and nuts 66 are provided on the threaded studs 62 and the washers 68 and nuts 66 clamp onto the radially inner surface 47 of the first annular wall 46, Similarly the tiles 52A, 52B of the fourth annular wall 52 are supported on the third annular wall 50 by suitable fasteners. In this example threaded studs 70 extend from the radially outer surface 53 of the tiles 52A, 52B through apertures 72 in the third annular wall 50 and washers 76 and nuts 74 are provided on the threaded studs 70 and the washers 76 and nuts 74 clamp onto the radially outer surface 51 of the third annular wall 50.

The tiles 48A of the second annular wall 48 are provided with a plurality of pedestals 78 which extend in a radially inwardly direction from the radially inner, cold, surface 49 of the tiles 48A and the tiles 52A of the fourth annular wall 52 are provided with a plurality of pedestals 80 which extend in a radially outwardly direction from the radially outer, cold, surface 53 of the tiles 52A. The pedestals 78 and 80 provide cooling of the tiles 48A and 52A respectively by conducting heat away from the tiles 48A and 52A and the heat is transferred to coolant flowing around and between the pedestals 78, 80.

The tiles 48B of the second annular wall 48 are provided with a plurality of effusion cooling apertures 82 which extend through the tiles 48B from the radially inner surface 49 to the radially outer surface 49B of the tiles 48B and the tiles 52B of the fourth annular wall 52 are provided with a plurality of effusion cooling apertures 84 which extend through the tiles 52B from the radially outer surface 53 to the radially inner surface 53B of the tiles 52B. The effusion cooling apertures 82 and 84 provide film cooling of the radially outer surface 49B of the tiles 48B and the radially inner surface 53B of the tiles 52B.

The first annular wall 46 has a plurality of apertures 86 extending there-through to supply coolant into a chamber 88 defined between the first annular wall 46 and the tiles 48A, 48B of the second annular wall 48. The third annular wall 50 has a plurality of apertures 90 extending there-through to supply coolant into a chamber 92 defined between the third annular wall 50 and the tiles 52A, 52B of the fourth annular wall 52. The coolant supplied to the chambers 88 and 92 as mentioned above flows through the chambers 88 and 92 by flowing around and between the pedestals 78 and 80 respectively to provide cooling of the tiles 48A and 52A. The coolant supplied to the chambers 88 and 92 as mentioned above flows through the effusion cooling apertures 82 and 84 to provide film cooling of the radially outer surface 49B of the tiles 48B and the radially inner surface 53B of the tiles 52B. The radially outer surface 49B of each tile 48A, 48B may have a thermal barrier coating and similarly the radially inner surface 53B of each tile 52A, 52B may have a thermal barrier coating.

The thermal barrier coating may comprise a bond coating and a ceramic coating. The bond coating may comprise an aluminide coating or a MCrAlY coating, where M is one or more of nickel, cobalt or iron, Cr is chromium, Al is aluminium and Y is one or more of yttrium, lanthanum and other rare earth. The ceramic coating may comprise stabilised zirconia, for example yttria stabilised zirconia.

Figure 3:
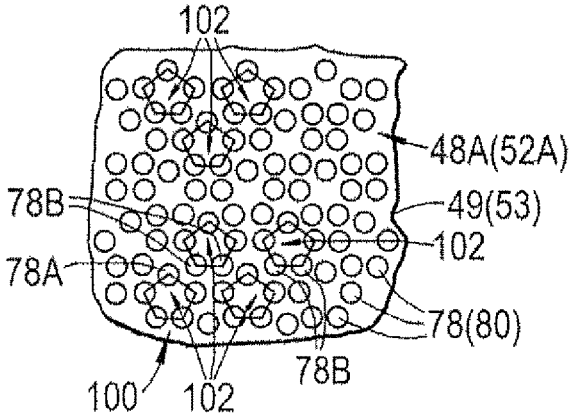
FIG. 3 is an enlarged plan view of a tile according to the present disclosure.

A tile 48A, 52A with an arrangement of pedestals 78, 80 according to the present disclosure is shown in FIG. 3. The pedestals 78, 80 are arranged in a predetermined pattern 100, wherein the predetermined pattern 100 provides the tile 48A, 52A with a more uniform stiffness in all directions, e.g. the tile 48A, 52A has substantially the same stiffness, or strength, in each cross-section through the tile 48A, 52A. As shown in FIG. 3 the pedestals 78, 80 are arranged in a pentagonal pattern 100. The pentagonal pattern 100 comprises a plurality of pentagons 102. Each pentagon 102 comprises five pedestals 78, 80 and each pedestal 78, 80 is arranged at a respective corner of the pentagon 102. It is to be noted that each pedestal 78 is arranged in a single pentagon 102 only and is not shared by an adjacent pentagon 102. In this pentagonal pattern 100 the pedestal 78A positioned above the base of one pentagon 102 is positioned between the pedestals 78B forming the base of two adjacent pentagons 102. The pedestal 78A positioned above the base of one pentagon 102 is not aligned with the pedestals 78B forming the base of the two adjacent pentagons 102, but is positioned so that the pedestal 78A overlaps the pedestals 78B by up to half the diameter of the pedestal 78A, 78B. At least one of the tiles 48A, 52A has the pedestals 78, 80 arranged such that there are no direct lines of sight across the tile 48A, 52A and between the pedestals 78, 80 on the first surface 49, 53 of the tile 48A, 52A. Preferably a plurality of the tiles 48A, 52A have the pedestals 78, 80 arranged such that there are no direct lines of sight across the tile 48A, 52A and between the pedestals 78, 80 on the first surface 49, 53 of the tile 48A, 52A. Preferably all of the tiles 48A, 52A have the pedestals 78, 80 arranged such that there are no direct lines of sight across the tile 48A, 52A and between the pedestals 78, 80 on the first surface 49, 53 of the tile 48A, 52A. Thus, there are no direct lines across the first surface 49, 53 of the tile 48A, 52A without at least one pedestal 78, 80.

Figure 4:
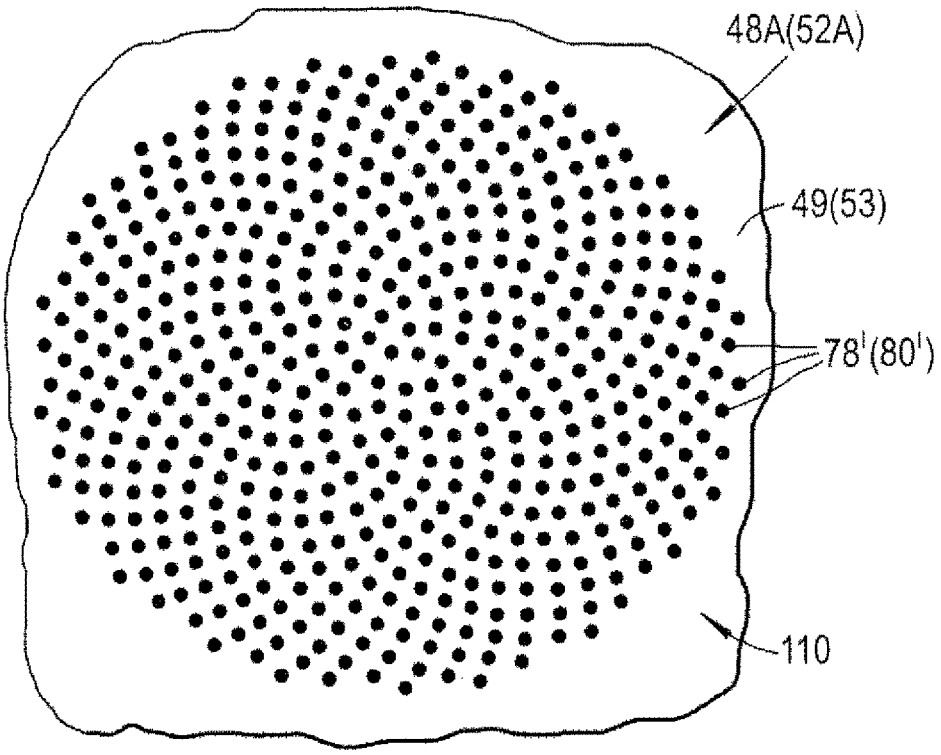
FIG. 4 is an enlarged plan view of a further tile according to the present disclosure.

A tile 48A, 52A with a further arrangement of pedestals 78', 80' according to the present disclosure is shown in FIG. 4. The pedestals 78', 80' are arranged in a predetermined pattern 110, wherein the predetermined pattern 110 provides the tile 48A, 52A with substantially uniform stiffness in all directions, e.g. the tile 48A, 52A has substantially the same stiffness, or strength, in each cross-section through the tile 48A, 52A. As shown in FIG. 4 the pedestals 78', 80' are arranged on Fermat's spiral, a parabolic spiral, in which the pedestals 78' 80' are arranged with Fibonacci number ordering, e.g. $\theta=2\pi/\phi^2\times n$, $r=c\sqrt{n}$, $\theta=n\times137.508°$, where n is the index number of the pedestal 78' 80', c is a constant scaling factor and r is the radius or distance from the centre. At least one of the tiles 48A, 52A has the pedestals 78', 80' arranged such that there are no direct lines of sight across the tile 48A, 52A and between the pedestals 78', 80' on the first surface 49, 53 of the tile 48A, 52A. Preferably a plurality of the tiles 48A, 52A have the pedestals 78', 80' arranged such that there are no direct lines of sight across the tile 48A, 52A and between the pedestals 78', 80' on the first surface 49, 53 of the tile 48A, 52A. Preferably all of the tiles 48A, 52A have the pedestals 78', 80' arranged such that there are no direct lines of sight across the tile 48A, 52A and between the pedestals 78', 80' on the first surface 49, 53 of the tile 48A, 52A. Thus, there are no direct lines across the first surface 49, 53 of the tile 48A, 52A without at least one pedestal 78', 80'.

Figure 5:
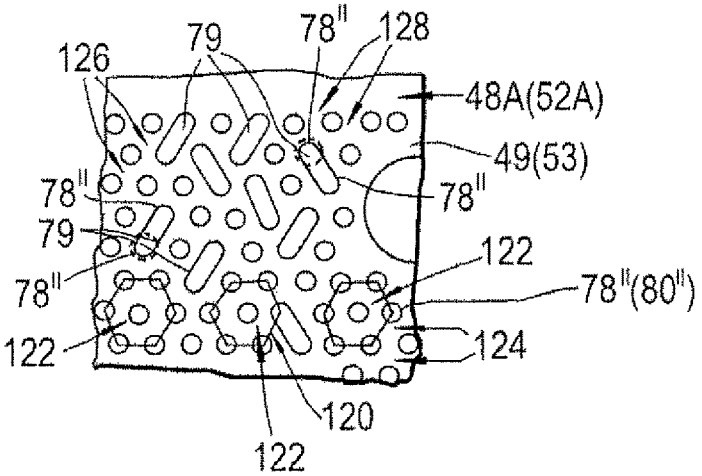
FIG. 5 is an enlarged plan view of an alternative tile according to the present disclosure.

A tile 48A, 52A with another arrangement of pedestals 78", 80" according to the present disclosure is shown in FIG. 5. The pedestals 78", 80" are arranged in a predetermined pattern 120, wherein the predetermined pattern 120 provides the tile 48A, 52A with a more uniform stiffness in all directions, e.g. the tile 48A, 52A has substantially the same stiffness, or strength, in each cross-section through the tile 48A, 52A. As shown in FIG. 5 the pedestals 78", 80" are arranged in a regular hexagonal pattern 120. The hexagonal pattern 120 comprises a plurality of hexagons 122. Each hexagon 122 comprises seven pedestals 78", a pedestal 78" is arranged at each corner of the hexagon 122 and a pedestal 78" is arranged at the centre of each hexagon 122. It is to be noted that most of the pedestals 78" are arranged in a several hexagons 122 and thus most pedestals 78" are shared by adjacent hexagons 122. The pedestals 78" are arranged in parallel rows and the rows of pedestals 78" define a plurality of parallel channels 124, 126 and 128. The parallel channels 124 run across the page from left to right, the parallel channels 126 run from top left to bottom right at 120° to the channels 124 and the parallel channels 128 run from top right to bottom left at 120° to the channels 124 and at 120° to the channels 126. A plurality of interconnecting members 79 are provided, each interconnecting member 79 connects two adjacent pedestals 78", at least one interconnecting member 79 is arranged to extend across each of the channels 124, 126 and 128 and in particular a plurality of interconnecting members 79 extend across each channel 124, 126 and 128. At least one of the tiles 48A, 52A has interconnecting members 79 arranged between adjacent pedestals 78", 80" such that there are no direct lines of sight across the tile 48A, 52A and between the pedestals 78, 80 on the first surface 49, 53 of the tile 48A, 52A. Preferably a plurality of the tiles 48A, 52A have interconnecting members 79 arranged between adjacent pedestals 78", 80" such that there are no direct lines of sight across the tile 48A, 52A and between the pedestals 78", 80" on the first surface 49, 53 of the tile 48A, 52A. Preferably all of the tiles 48A, 52A have interconnecting members 79 arranged between adjacent pedestals 78", 80" such that there are no direct lines of sight across the tile 48A, 52A and between the pedestals 78", 80" on the first surface 49, 53 of the tile 48A, 52A. Thus, there are no direct lines across the first surface 49, 53 of the tile 48A, 52A without at least one pedestal 78", 80".

Figure 6:
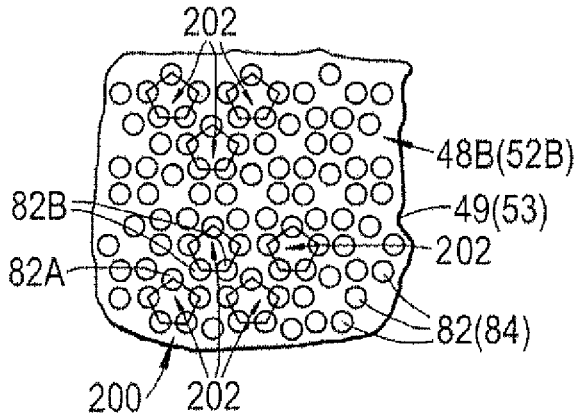
FIG. 6 is an enlarged plan view of another tile according to the present disclosure.

A tile 48B, 52B with an alternative arrangement of effusion cooling apertures 82, 84 according to the present disclosure is shown in FIG. 6. The effusion cooling apertures 82, 84 are arranged in a predetermined pattern 200, wherein the predetermined pattern 200 provides the tile 48B, 52B with a more uniform stiffness in all directions, e.g. the tile 48B, 52B has substantially the same stiffness, or strength, in each cross-section through the tile 48B, 52B. As shown in FIG. 6 the effusion cooling apertures 82, 84 are arranged in a pentagonal pattern 200. The pentagonal pattern 200 comprises a plurality of pentagons 202. Each pentagon 202 comprises five effusion cooling apertures 82, 84 and each effusion cooling apertures 82, 84 is arranged at a respective corner of the pentagon 202. It is to be noted that each effusion cooling apertures 82, 84 is arranged in a single pentagon 202 only and is not shared by an adjacent pentagon 202. In this pentagonal pattern 200 the effusion cooling aperture 82A positioned above the base of one pentagon 202 is positioned between the effusion cooling apertures 82B forming the base of two adjacent pentagons 202. The effusion cooling aperture 82A positioned above the base of one pentagon 202 is not aligned with the effusion cooling apertures 82, 84 forming the base of the two adjacent pentagons 202, but is positioned so that the effusion cooling apertures 82A overlaps the effusion cooling apertures 82B by up to half the diameter of the effusion cooling apertures 82A, 82B. Thus, there are no direct lines across the first surface 49, 53 of the tile 48B, 52B without at least one effusion cooling apertures 82, 84.

Figure 7:
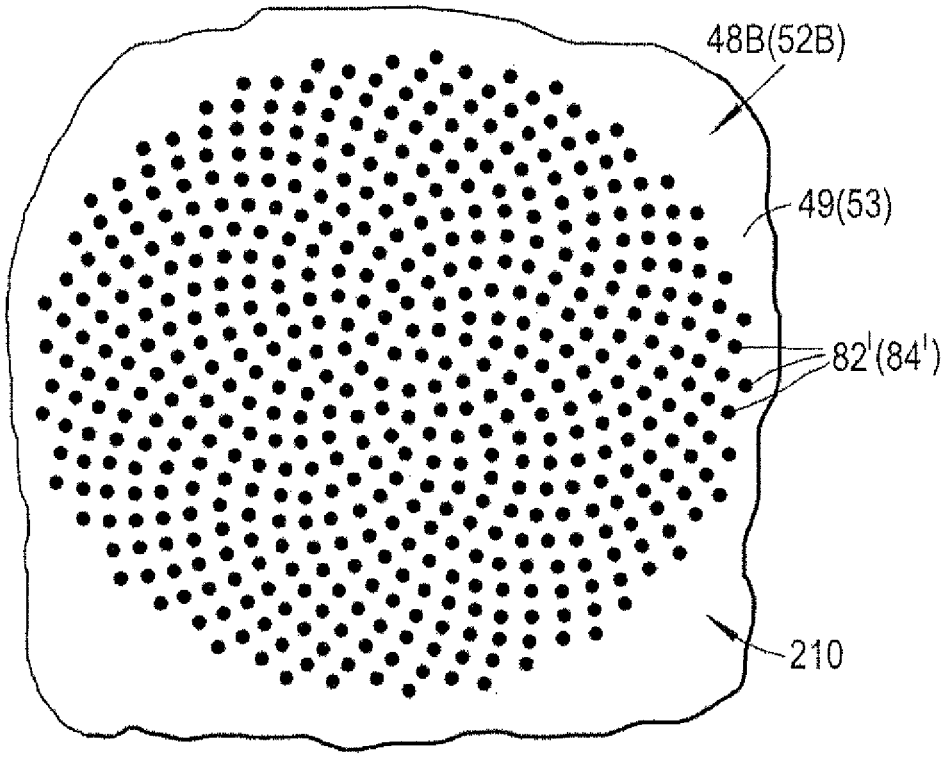
FIG. 7 is an enlarged plan view of an additional tile according to the present disclosure.

A tile 48B, 52B with an additional arrangement of effusion cooling apertures 82', 84' according to the present disclosure is shown in FIG. 7. The effusion cooling apertures 82', 84' are arranged in a predetermined pattern 210, wherein the predetermined pattern 210 provides the tile 48B, 52B with substantially uniform stiffness in all directions, e.g. the tile 48B, 52B has substantially the same stiffness, or strength, in each cross-section through the tile 48B, 52B. As shown in FIG. 7 the effusion cooling apertures 82', 84' are arranged on Fermat's spiral, a parabolic spiral, in which the effusion cooling apertures 82', 84' are arranged with Fibonacci number ordering, e.g. $\theta=2\pi/\phi^2\times n$, $r=c\sqrt{n}$, $\theta=n\times 137.508°$, where n is the index number of the effusion cooling apertures 82', 84', c is a constant scaling factor and r is the radius or distance from the centre. Thus, there are no direct lines across the first surface 49, 53 of the tile 48B, 52B without at least one effusion cooling apertures 82', 84'.

Figure 8:
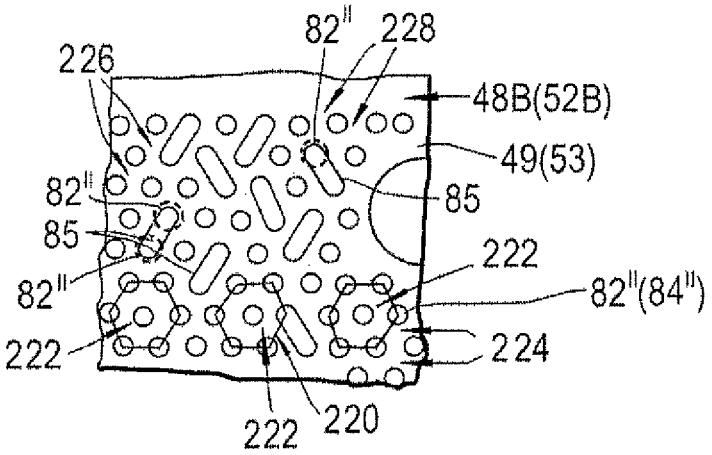
FIG. 8 is an enlarged plan view of a further alternative tile according to the present disclosure.

A tile 48B, 52B with another arrangement of effusion cooling apertures 82", 84" according to the present disclosure is shown in FIG. 8. The effusion cooling apertures 82", 84" are arranged in a predetermined pattern 220, wherein the predetermined pattern 220 provides the tile 48B, 52B with a more uniform stiffness in all directions, e.g. the tile 48B, 52B has substantially the same stiffness, or strength, in each cross-section through the tile 48B, 52B. As shown in FIG. 8 the effusion cooling apertures 82", 84" are arranged in a regular hexagonal pattern 220. The hexagonal pattern 220 comprises a plurality of hexagons 222. Each hexagon 222 comprises seven effusion cooling apertures 82", 84", an effusion cooling apertures 82" is arranged at each corner of the hexagon 222 and an effusion cooling apertures 82" is arranged at the centre of each hexagon 222. The effusion cooling apertures 82" are arranged in parallel rows and the rows of effusion cooling apertures 82" defining a plurality of parallel channels 224, 226 and 228. The parallel channels 224 run across the page, the parallel channels 226 run from top left to bottom right at 120° to the channels 224 and the parallel channels 228 run from top right to bottom left at 120° to the channels 224 and at 120° to the channels 226. The channels 224, 226 and 228 are webs of material of the tile 48B, 52B between the effusion cooling apertures 82", 84". A plurality of slots 85 are provided, each slot 85 extends between two adjacent effusion cooling apertures 82", 84" and at least one slot 85 is arranged to extend across each of the channels 224, 226 and 228. Preferably a plurality of slots 85 extend across each channel 224, 226 and 228. The slots 85 may or may not interconnect two adjacent effusion cooling apertures 82", 84". Thus, there are no direct lines across the first surface 49, 53 of the tile 48B, 52B without at least one effusion cooling apertures 82", 84" or slot 85.

In the case of a pedestalled tile, the pedestals may be arranged on the radially inner surface of the tile of the second annular wall or the radially outer surface of the tile of the fourth annular wall in a random, irregular, pattern or random, irregular, arrangement. It is to be noticed that the random, irregular, pattern of pedestals ensures that the stiffness of the tile is substantially the same in all directions and that there are no lines or sections which are substantially weaker than any other lines or sections of the tile. Thus, there are no direct lines across the first surface of the tile without at least one pedestal. Alternatively, in the case of an effusion cooled tile, the effusion cooling apertures may be arranged on the tile of the second annular wall or the tile of the fourth annular wall in a random, irregular, pattern or random, irregular, arrangement. It is to be noticed that the random, irregular, pattern of effusion cooling apertures ensures that the stiffness of the tile is substantially the same in all directions and that there are no lines or sections which are substantially weaker than any other lines or sections of the tile. Thus, there are no direct lines across the first surface of the tile without at least effusion cooling aperture.

In the case of a regular square pattern of pedestals, the pedestals are arranged in parallel rows and parallel columns and the rows and columns of pedestals define a plurality of parallel channels. A first set of parallel channels run parallel to and between the rows of pedestals and a second set of parallel channels run parallel to and between the columns of pedestals. A plurality of interconnecting members are provided, each interconnecting member connects two adjacent pedestals, at least one interconnecting member is arranged to extend across each of the channels and in particular a plurality of interconnecting members extend across each channel. At least one of the tiles has interconnecting members arranged between adjacent pedestals such that there are no direct lines of sight across the tile and between the pedestals on the first surface of the tile. In general for other regular patterns of pedestals which have pedestals arranged in parallel rows, interconnecting members may be provided between adjacent pedestals so that at least one interconnecting member extends across each of the channels and in particular a plurality of interconnecting members extend across each channel such that there are no direct lines of sight across the tile and between the pedestals on the first surface of the tile. Thus, there are no direct lines across the first surface of the tile without at least one pedestal or at least one interconnecting member.

In the case of a regular square pattern of effusion cooling apertures, the effusion cooling apertures are arranged in parallel rows and parallel columns and the rows and columns of effusion cooling apertures define a plurality of parallel channels. A first set of parallel channels run parallel to and between the rows of effusion cooling apertures and a second set of parallel channels run parallel to and between the columns of effusion cooling apertures. A plurality of slots are provided, each slot extends between two adjacent effusion cooling apertures, at least one slot is arranged to extend across each of the channels and in particular a plurality of slots extend across each channel. In general for other regular patterns of effusion cooling apertures which have effusion cooling apertures arranged in parallel rows, slots may be provided extending between adjacent effusion cooling apertures so that at least one slot extends across each of the channels and in particular a plurality of slots extend across each channel on the first surface of the tile. Thus, there are no direct lines across the first surface of the tile without at least one effusion cooling aperture or at least one slot.

Also in the case of a regular pattern of effusion cooling apertures which have effusion cooling apertures arranged in parallel rows, the pattern of effusion cooling holes may be made irregular for example by omitting a predetermined number of effusion cooling apertures in each row of effusion cooling holes on the first surface tile, for example every eighth effusion cooling aperture in a row of effusion cooling apertures in a hexagonal pattern of effusion cooling apertures.

The tiles with pedestals are provided with pedestals on the tiles in the predetermined pattern using conventional casting techniques and the tiles with effusion cooling are provided with effusion cooling apertures in the predetermined pattern using conventional drilling techniques, e.g. EDM, ECM, laser drilling etc. The machine tools are easily programmed to drill the effusion cooling apertures though the tiles in the correct positions. The tiles may comprise a suitable alloy, for example a nickel, cobalt or iron superalloy.

The advantage of the present disclosure is that the predetermined pattern of pedestals and/or effusion cooling apertures in the tiles avoids weak sections which have reduced bending stiffness and as a result the working life of the tiles may be increased and the reliability of the combustion chamber is increased. A further advantage is that the time interval for the periodic inspection of a combustion chamber using a boroscope to determine whether a tile has cracked may be increased and this may reduce maintenance costs.

All of the pedestals or effusion cooling apertures may have the same cross-sectional shape. The pedestals or effusion cooling apertures may be circular in cross-section. All of the pedestals or effusion cooling apertures may be circular in cross-section. Each tile may be secured to the annular wall by any other suitable fastener arrangement.

The predetermined pattern may be an aperiodic pattern.

Although the description has referred to a combustion chamber comprising tiles having a predetermined pattern of pedestals and comprising tiles having a predetermined pattern of effusion cooling apertures this was for example only. A combustion chamber may comprise tiles having a predetermined pattern of pedestals. Alternatively a combustion chamber may comprise tiles having a predetermined pattern of effusion cooling apertures. Additionally a combustion chamber may comprise tiles having a predetermined pattern of effusion cooling apertures and a predetermined pattern of pedestals.

Although the description has referred to a radially inner annular wall and a radially outer annular wall of an annular combustion chamber, the present disclosure is also applicable to an annular wall of a tubular combustion chamber. The radially inner surface of each tile may have a thermal barrier coating.

Although the description has referred to a radially inner annular wall and a radially outer annular wall of an annular combustion chamber, the present disclosure is also applicable to an annular upstream end wall of an annular combustion chamber. In this example each tile, in this case a heat shield, has a plurality of pedestals extending in an upstream direction from an upstream surface of the tile and a downstream surface of each tile may have a thermal barrier coating.

Although the present disclosure has referred to annular combustion chamber wall arrangement including an annular wall comprising a plurality of tiles supported on a further annular wall it is equally applicable to an annular combustion chamber wall arrangement simply comprising an annular wall which has effusion cooling apertures extending there-through from a first surface to a second surface.

Alternatively, it may be possible to provide the predetermined pattern in one or more localised regions of an annular wall, or one or more localised regions of a tile, so that the predetermined pattern provides the one or more localised regions of the annular wall, or one or more localised regions of the tile, with a more uniform stiffness in all directions. This is applicable to localised regions of the annular wall, or tile, corresponding to regions which are subject to greater vibration response, greater thermal stresses and/or greater pressure stresses than the remainder of the annular wall, or tile.

The annular combustion chamber wall arrangement may be a gas turbine engine annular combustion chamber wall arrangement. The gas turbine engine may be an aero gas turbine engine, a marine gas turbine engine, an industrial gas turbine engine or an automotive gas turbine engine. The aero gas turbine engine may be a turbofan gas turbine engine, a turboprop gas turbine engine, a turbojet gas turbine engine or a turbo shaft gas turbine engine.

The invention claimed is:

1. An annular combustion chamber wall arrangement comprising:

an annular wall having a first surface and a second surface;

circular effusion cooling apertures extending through the annular wall from the first surface of the annular wall to the second surface of the annular wall, wherein:

the circular effusion cooling apertures are arranged in a regular hexagonal pattern such that the circular effusion cooling apertures are arranged in parallel rows and the parallel rows of circular effusion cooling apertures define channels;

slots are provided that each extend through the annular wall from the first surface of the annular wall to the second surface of the annular wall and connect two adjacent circular effusion cooling apertures, and at least one of the slots is arranged to extend across each of the channels.

2. The annular combustion chamber wall arrangement as claimed in claim 1, wherein the circular effusion cooling apertures are arranged in the regular hexagonal pattern such that one of the circular effusion cooling apertures is arranged at each corner of each hexagon of the regular hexagonal pattern and one of the circular effusion cooling apertures is arranged at the centre of each hexagon.

3. The annular combustion chamber wall arrangement as claimed in claim 2, wherein more than one of the slots extends across each of the channels.

* * * * *